United States Patent [19]

Brooksby

[11] 4,264,309

[45] Apr. 28, 1981

[54] PROJECTED IMAGE TARGET APPARATUS

[76] Inventor: Brian T. Brooksby, 156 Earlsbrook Rd., Redhill, Surrey, England

[21] Appl. No.: 72,776

[22] Filed: Sep. 5, 1979

[30] Foreign Application Priority Data

Sep. 8, 1978 [GB] United Kingdom ..... 36074/78

[51] Int. Cl.[3] ..... F41G 3/26

[52] U.S. Cl. ..... 434/20; 434/22

[58] Field of Search ..... 35/25; 273/310, 312, 273/313, 316

[56] References Cited

U.S. PATENT DOCUMENTS

| | | | |
|---|---|---|---|
| 2,995,834 | 8/1961 | Rowe | 273/312 X |
| 3,882,496 | 5/1975 | Lewis et al. | 35/25 X |
| 3,904,204 | 9/1975 | Yokoi | 273/312 |
| 4,052,066 | 10/1977 | Ohta | 273/312 |
| 4,175,748 | 11/1979 | Yokoi | 273/316 |

*Primary Examiner*—William H. Grieb

[57] ABSTRACT

Projected image target apparatus for gunnery and missile launcher training, comprising a screen onto which a motion picture target is projected from a projector, a light beam projector on the weapon for projecting onto the screen an invisible light beam along the line-of-sight of the weapon, a light beam projector for projecting a visible light beam onto the screen and a system for controlling the projector and light beam projectors. The control system tracks movement of the beam of invisible light and upon firing of the weapon automatically discontinues the tracking and utilizes the position that the invisible beam of light had at the instant of firing the weapon as a datum relative to which the visible light beam is moved automatically in accordance with the ballistic performance of the projectile to simulate trajectory drift and fall of the projectile over the simulated range of the target projected onto the screen. The film may be stopped in the projector a predetermined period of time after the firing of the weapon to simulate the travel time of the projectile over the simulated range, the beam of visible light then indicating on the screen the point of impact relative to the projected target image.

16 Claims, 4 Drawing Figures

PROJECTED IMAGE TARGET APPARATUS

BACKGROUND OF THE INVENTION

This invention relates to a projected image target apparatus for use in the training of direct weapon fire, such as tank gunnery and direct fire missile launchers.

SUMMARY OF THE INVENTION

This invention relates as aforesaid to a projected image target apparatus for use in the training of direct weapon fire, such as tank gunnery and direct fire missile launchers.

According to the present invention there is provided a projected image target apparatus, comprising a screen, a projector for projecting a target image onto the screen, a device for projecting from a weapon a first light beam onto the screen along the line-of-sight of the weapon, a device for projecting a second light beam onto the screen, and a system for controlling operation of the projector and the devices for projecting said first and second light beams. The control system tracks movement of the point of contact of said first light beam on the screen, and upon firing of the weapon utilizes the position that the point of contact of said first light beam had at the instant of firing the weapon as a datum point relative to which the point of contact of the second light beam with the screen is moved to a corrected position which simulates for fall and drift of the simulated projectile or missile fired by the weapon and represents the point of impact of the projectile or missile relative to the point of aim of the weapon at the instant of firing.

In use of the apparatus according to the present invention, the user of the weapon is seeing on the screen a target image which is at a simulated range which is different from the actual constant range between the weapon and the target, i.e. the screen. For example the actual range or distance between the screen and the weapon may be 6 meters whereas the image which he is aiming at may be at a simulated range of 2000 meters.

The apparatus may be provided with means to stop the projected image after a predetermined period of time has elapsed after firing the weapon in order to simulate the travel time of the projectile (or missile) and to then indicate upon the screen the point of impact (relative to the target image) simulating the trajectory fall of shot by moving the indicated point downwards (relative to the datum point of aim of the weapon upon the screen when the weapon was fired) and to simulate the trajectory drift of the projectile by moving the indicated point sideways (relative to the point of aim of the weapon upon the screen when the weapon was fired).

When the apparatus according to the present invention is used for the training of the operation of missile launchers the means for projecting the second light beam is switched on at the instant of firing, accompanied by the simulated sound of the missile being fired, and remains visible during the simulated travel time of the missile responding to the control of the missile launcher with the characteristics of the missile of the type being simulated until the travel time to the simulated range has elapsed at which time the image of the target may be stopped and the response to the launcher is stopped therefore indicating to the marksman the point relative to the target image where the missile or projectile would have been after travelling the simulated range. The switching on of the second light beam is usually achieved by an electrical signal initiated by the closing of a swtich on the firing control of the weapon. The vertical and horizontal movement of the impact point can be carried out by mounting the means for projecting the second light beam on a pivotable carrier so that the light beam projector is tilted in order to move the impact point of the second light beam on the screen vertically downwards and slewed in order to move the impact point horizontally or by providing a movable mirror system which moves the impact point vertically and horizontally, or by the use of acoustic-optical beam deflectors or by the use of electro-optical beam deflectors.

The ballistic performance of a projectile or missile for any given range varies from one type of weapon to another and upon the calibre of the projectile resulting in a different vertical and horizontal movement of the impact point of the second light beam for different weapons at the same range. The control apparatus for controlling operation of the motion picture target apparatus according to the present invention preferably comprises means for storing or calculating for each of a plurality of different types of weapon the flight times, trajectory fall and trajectory drift of a projectile or missile for a plurality of different range setting of the weapon, said means in use of the apparatus producing electrical outputs dependent upon flight time and trajectory fall and drift; means for selecting the stored or calculated information relating to a particular weapon; means for obtaining the range in accordance with the assimulated range of the target image projected on the screen; means responsive to the produced electrical output of the storing or calculating means dependent upon flight time of the projectile or missile for stopping the movement of the image on the screen; means for detecting the firing of a weapon for producing a start signal; detection means for the detecting of the position of the point of contact of the first light beam on the screen; means for adjusting the detection means so that the detection means maintains the point of contact of the first light beam in the centre of the field of view of the detection means; and means responsive to the produced electrical output of the storing or calculating means dependent upon the trajectory fall and drift of the projectile for moving the point of contact of the second light beam on the screen vertically and horizontally on the screen.

When the apparatus is provided with means for stopping the projected image the control means can include means for automatically resetting the control apparatus to re-start movement of the film in the projector and recentre the point of contact of the first light beam in the field of view of the detector means after a predetermined period of time has elapsed after stopping movement of the film through the projector and the adjusted position of the point of contact of the second light beam to allow for assessment of the result of the firing of the weapon.

BRIEF DESCRIPTION OF THE DRAWINGS

To the accomplishment of the foregoing and related ends, the invention then comprises the features hereafter fully described and particularly pointed out in the claims, the following description and annexed drawings setting forth in detail certain illustrative embodiments of the invention, these being indicative however of only some ways in which the principle of the invention may be employed.

In said annexed drawings.

DESCRIPTION OF THE PREFERRED EMBODIMENTS

Figure 1:
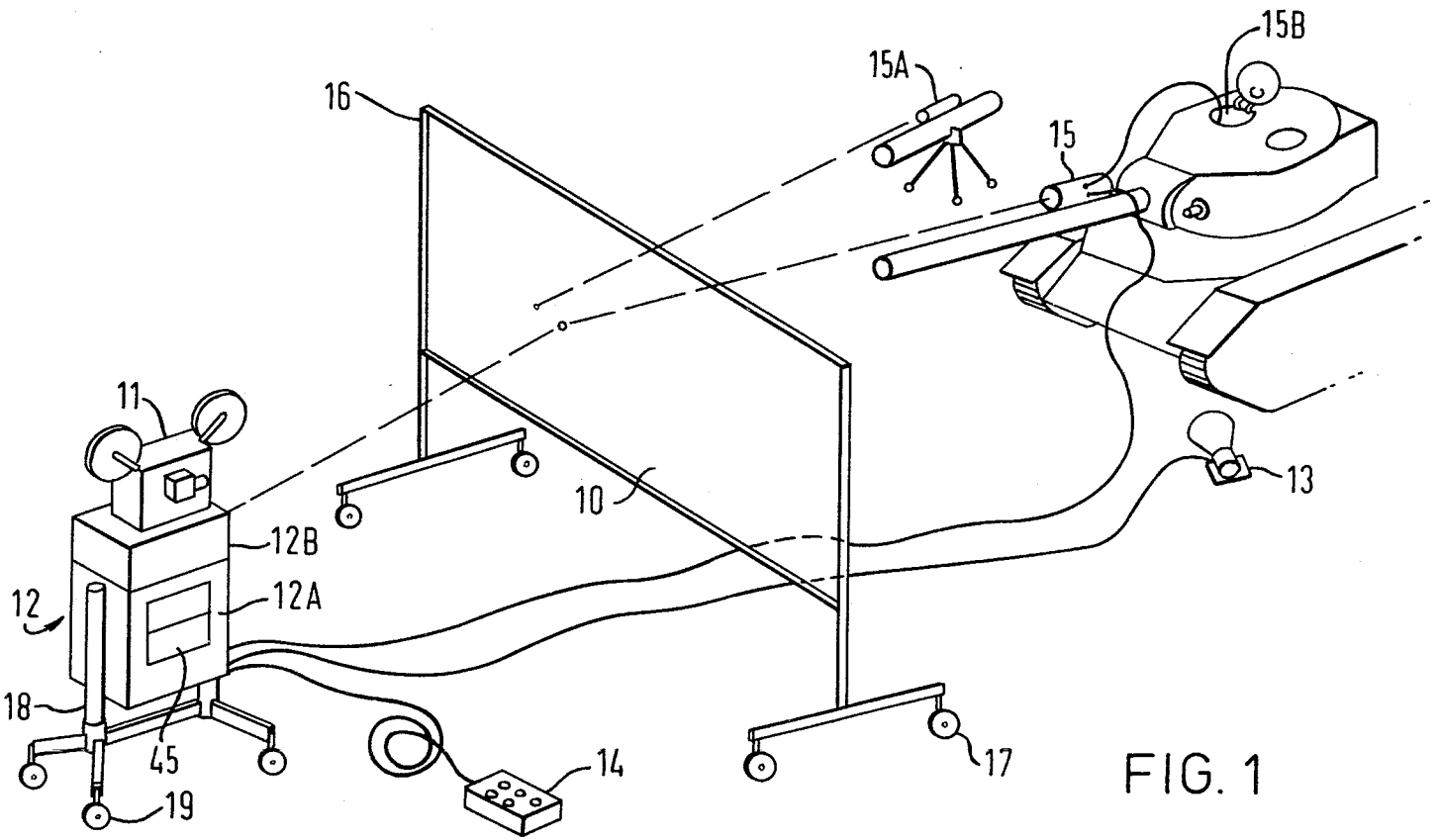
FIG. 1 is a diagrammatic perspective view of a projected image target apparatus according to the present invention.

The projected image target apparatus shown diagrammatically in FIG. 1 consists of a target screen 10, a projector 11 for projecting a target image onto the screen 10, a console 12, consisting of an electronics section 12A and an optics section 12B on which the projector 11 is placed, a loud speaker 13, a remote control device 14, an invisible light beam projector 15 projecting along the line-of-sight of the gun of a tank and as shown at 15A an invisible light beam projector projecting along the line-of-sight of a missile launcher and a firing signal apparatus 15B (inside the tank) for producing an electrical output signal when the gun or missile launcher is fired. The projector 11 may be a film projector or a television picture projector.

The target screen 10 consists of a translucent back projection screen (or alternatively a front projection screen if front projection is used) and a supporting framework 16 mounted on wheels 17.

The console 12 is mounted on a support 18 movable on wheels 19 and houses part of the components of the control apparatus for controlling the film projector 11 and the optical apparatus in the optics section 12B as will be described later.

Figure 2:
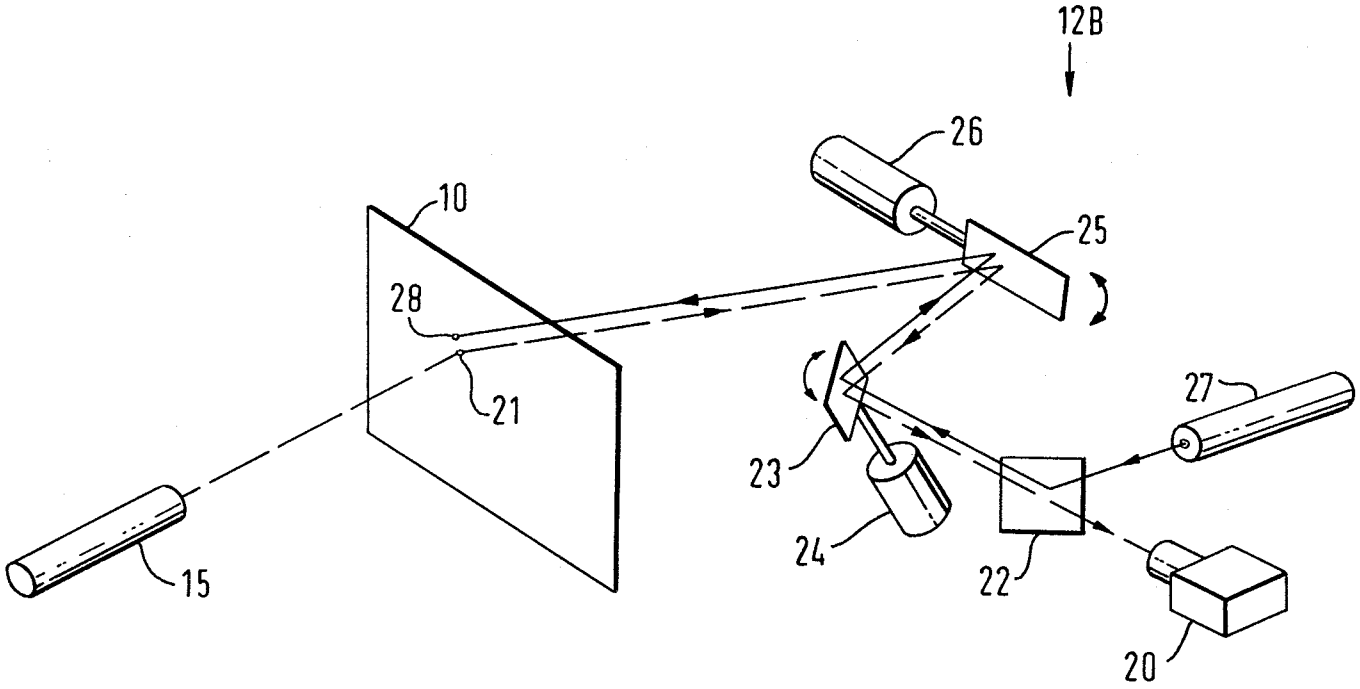
FIG. 2 is a diagrammatic perspective view of the optical apparatus.

The optics section 12B is shown in FIG. 2 together with the screen 10 and the line-of-sight projector 15 which projects the beam of invisible light (shown dashed) on to the screen 10. A line-of-sight detector 20 is focused on to the spot 21 where the invisible light strikes the screen 10 via a mirror 22; via a pivotable mirror 23 driven by a galvanometer 24; via the pivotable mirror 25 driven by a galvanometer 26. An impact point projector 27 projects a beam of visible light coaxially onto a spot 28 on to the screen 10 via the mirror 22; via the mirror 23; and via the mirror 25. In practice the two spots 21 and 28 on the screen 10 are superimposed but are shown separated in the drawing for clarity. The detector 20 controls the movement of the mirrors 23 and 25 so that the detector 20 always has the invisible spot 21 in the centre of the field of view of detector 20. Thus the detector 20 follows (tracks) the movements of the line-of-sight projector 15 (or 15A).

The firing signal apparatus 15B is preferably taken directly from the weapon firing electricl signal but it is possible to provide apparatus that is attached to the weapon firing trigger so that a firing signal may be obtained.

Figure 3:
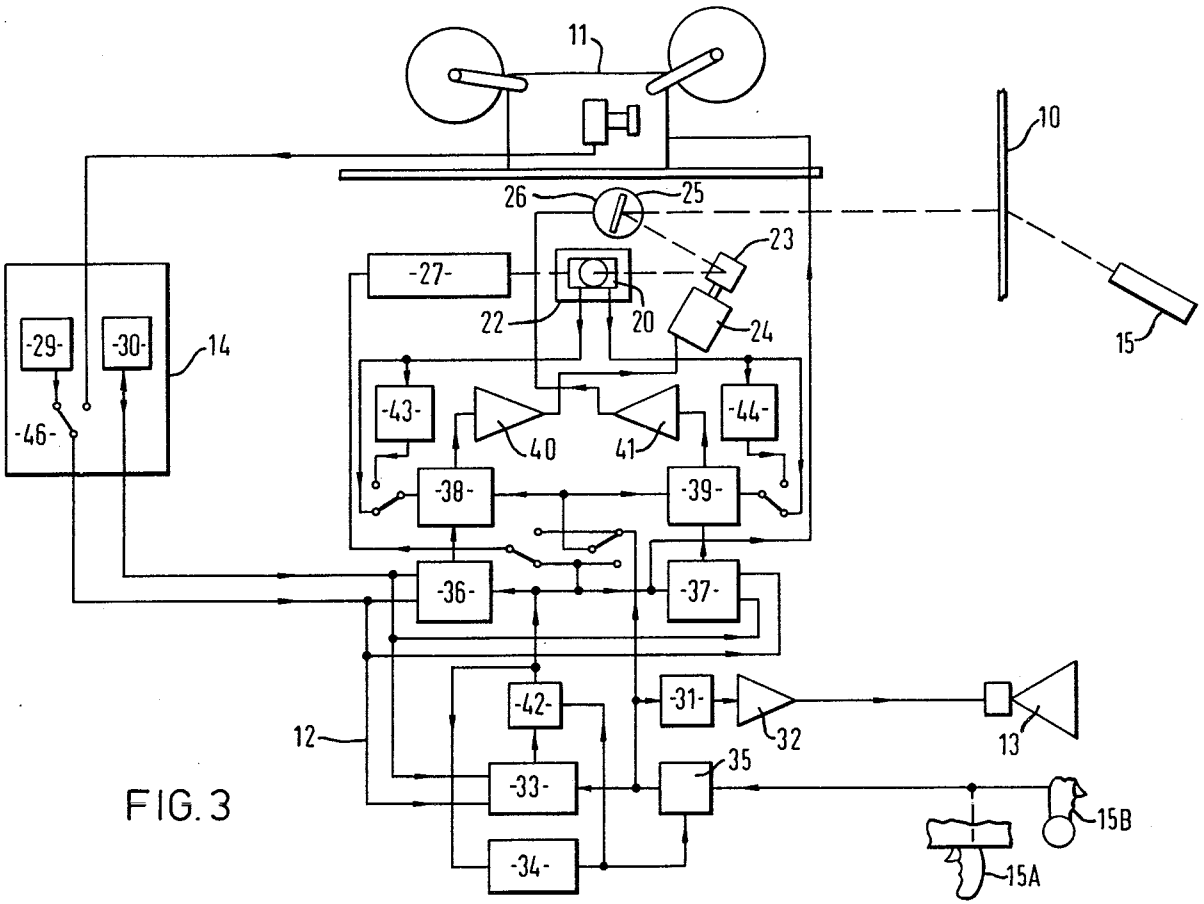
FIG. 3 is a block diagram of the circuit and components of the control apparatus.

The remote control 14, as shown in FIG. 3, is provided with a control 29 which is used to obtain the simulated range of the target manually, or the simulated range may be obtained from an automatic range device described later, and with a selector 30 which can select different types of weapon and in use selects the weapon in use. These controls may be duplicated on a panel 45 of the console 12.

In use of the target apparatus the projector 11 projects a target picture onto the screen 10. The user of the weapon then sees a target at an assimulated range which can vary where the target picture comprises a moving picture. The gunner takes aim upon the target through his sight and allows for the trajectory fall of the projectile by setting his sights higher than the target and allows for the trajectory drift of the projectile and speed of movement of the target by setting his sight in front of the target. During these movements of the weapon the line-of-sight projector 15 (or 15A) is invisibly marking on the screen 10 the exact position of the line-of-sight relative to the target and at the same time the detector 20 is tracking the movements of the spot 21 and therefore the movements of the gun sight. When the gunner is satisfied that the weapon is correctly aimed he fires the weapon, at that instant the sound of a weapon firing is simulated by a device 31, the sound amplified in an amplifier 32 and broadcast over the loudspeaker 13 and the tracking of the mirrors 23 and 25 are inhibited so that the aiming point of the sight at the time of firing is fixed and a flight time timer 33 is started. At the end of the flight time the film projector 11 is stopped and the trajectory fall, for the selected weapon at the assimulated range, is applied by moving the mirror 25 by means of galvanometer 26 so as to deflect the impact point 28 downwards and the trajectory drift, for the selected weapon at the assimulated range, is applied by moving the mirror 23 by means of galvanometer 24 so as to deflect the impact point 28 sideways and the impact point projector 27 is switched on. The gunner can then see, for a predetermined period of time, through his sights exactly where his projectile would have impacted upon the target and assess the result of the shot.

The control system for the apparatus of FIGS. 1 and 2 is shown in FIG. 3. Provided in the console 12 is a detector 20, the mirror 22, the pivotable mirror 23, the galvanometer 24, the pivotable mirror 25, the galvanometer 26, the visible light beam projector 27, the sound simulator 31, the audio amplifier 32, the flight timer 33, an assessment timer 34, a bistable circuit 35, a drift control device 36, a trajectory fall control device 37, an x axis tracking holding circuit 38, a y axis tracking holding circuit 39, an x axis servo control device 40, a y axis servo control device 41, a bistable 42 and missile response characteristic generator devices 43 and 44.

Provided on the remote control 14, is the weapon selector and indicator 30, the range selector and indicator 29, and a switch 46 for selecting the manual range selector 29 or the automatic range signal from the target projector 11.

The ballistic control devices 36 and 37 can be in the form of an information store and reader which stores ballistic information concerning the trajectory fall and drift of a projectile for a plurality of ranges of use. This information is provided for a plurality of different types of weapons and the type of weapon can be selected by the weapon selector 30. Therefore for each weapon selected the devices 36 and 37 has stored information relating to the trajectory of the projectile fired from that type of weapon for each range selected by the range selector 29. The flight time timer 33 also stores information relating to the flight time of the projectile of the selected weapon for each range selected by the range selector 29.

The devices 33, 36 and 37 instead of being in the form of information stores and readers may each be in the form of a computer which automatically calculates the values of trajectory fall, drift and flight time for the particular selected weapon and range.

The control system of FIG. 3 operates as follows:

The instructor selects by means of the weapon selector 30 the type of weapon and/or projectile which is to be used and this causes the ballistic control devices 36 and 37 and the flight time timer 33 to read or calculate the desired information in accordance with the range selected by the range selector 39, or an automatic range signal transmitted from the film on the projector 11, and each device 36 and 37 will produce an output signal. The detector 20 is controlling the mirrors 23 and 25, so as to track (follow) the point of aim of the gun sight, the controlling signal passes through the devices 38 and 39 into the servo control devices 40 and 41. The gunner operates the gun firing trigger 15B and a starting signal sets bi-stable 35. The output of the bi-stable 35 starts the flight time timer 33 and the sound simulator 31 and locks the holding devices 38 and 39 so that the mirrors 23 and 25 are immobilized and do not then respond to the tracking signals from the detector 20. After a period of time determined by the flight time timer 33 it will produce an output signal which is supplied to the bi-stable 42. The output of bi-stable 42 starts timer 34 and enables the outputs of 36 and 37 to be applied to holding devices 38 and 39, the signal from 36 and 37 are added to the signals already stored in 38 and 39 thus producing additional signals to go to servo amplifiers 40 and 41 causing the mirrors 23 and 25 to move giving the required trajectory fall and drift corrections to the original point of aim position which was stored when the firing trigger 15B was actuated and the output of bi-stable 42 stops the film projector 11 and switches on the visible impact point projector 27 thus indicating to the gunner the results of the projectile fired. After the assessment period of time determined by timer 34 the output of 34 resets bi-stable 35 and 42 to their original condition which then unlocks the holding devices 38 and 39 so as to allow the tracking signal from the detector 20 to again control the mirrors 23 and 25 and switches off the impact point projector 27 and restarts film projector 11.

When the apparatus is used for missile training the input signal to the holding devices 38 and 39 from the detector 20 is switched through the missile response characteristic generator devices 43 and 44 and the control signal to 38 and 39 is switched to the output of bi-stable 42 and the impact projector 27 is switched to the output of bi-stable 35 and operates as follows.

The instructor selects by means of the weapon selector 30 the type of missile to be simulated, devices 43 and 44 contain the flight characteristics of several missiles, causing ballistic control devices 36 and 37 not to have an output and the flight time timer 33 to read or calculate the desired information in accordance with the range selected by the range selector 29 or the automatic range signal from the target projector 11. The detector 20 controls the mirrors 23 and 25, so as to track (follow) the point of aim of the missile launcher sight, the control signal passes through the response devices 43 and 44 and through the holding devices 38 and 39 and into the servo control devices 40 and 41. The gunner operates the missile firing trigger 15A and a starting signal sets bi-stable 35. The output of 35 starts the flight time timer 33 and the sound simulator 31 and turns on the impact point projector 27 so that the gunner can see a simulation of the rear end of the missile in flight. The missile gunner then controls his missile in the normal manner on to the moving target image, the simulated missile responds as would the real missile to the tracking movements of the gunner. After a predetermined period of time determined by the flight time timer 33, depending upon the selected range and the selected weapon, the bi-stable 42 is set. The output of 42 starts assess time 34 and locks the holding devices 38 and 39 so that the mirrors 23 and 25 are immobilized and do not respond to the tracking signals from the detector 20 and the target projector 11 is stopped thus giving the gunner a visual indication of the position of the missile relative to the target image when the missile is at the same simulated range as the target so that the performance of the gunner can be assessed.

After a predetermined period of assess time the output of timer 34 resets bi-stable 35 and 42 to their original condition which then unlocks the holding devices 38 and 39 so as to allow the tracking signal from the detector 20 to again control the mirrors 23 and 25 and switches off the impact point projector 27.

Figure 4:
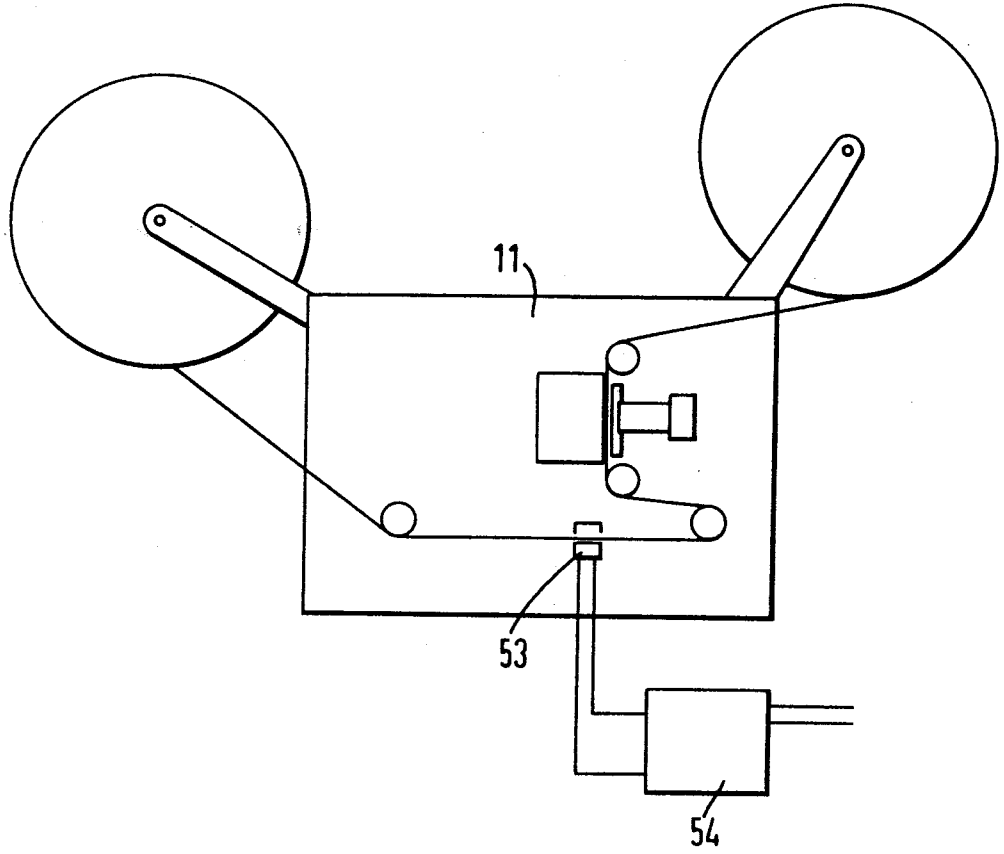
FIG. 4 is a diagram of a projector provided with automatic range reading facility.

The automatic range device is shown in FIG. 4. The range control may be switched to automatic range control so that the range information is obtained from the film (or television tape) being projected. This unit is in the console 12 and switched into use from the remote control 14. A sensor 53 is fitted to the film projector 11 and the outputs of the sensor 53 are taken to a serial to parallel data convertor 54, the output of which goes to devices 33, 36 and 37.

Instead of the pivotable mirrors 23 and 25 (FIG. 2) and associated components for effecting the driving of the mirrors, it is possible for the detector 20 and the impact point projector 27 to be mounted on pivotable and swingable tables which are moved by servo motors driven from the servo amplifiers 40 and 41.

Instead of the coaxial embodiment previously described a coincident embodiment is possible where the impact point projector could have an optical path entirely separate from the optical path of the detector. The impact point projector would have a duplicate pair of pivotable mirrors and galvanometers. The galvanometers would be controlled by a duplicate pair of driver amplifiers so as to maintain the coincidence of the invisible spot 21 and the visible spot 28. Then the detector could continue to track the invisible spot 21 while the impact point projector is showing, with the visible spot 28, the result of the previous shot on another part of the screen.

The embodiments described can also display to the gunner the effect of firing rounds with tracer illumination. This is achieved by arranging that the impact point projector is switched on, and pulsed, at the moment the gun is fired (in simulation). The trajectory fall and drift is gradually applied to the mirrors as the flight time is progressing, until the flight time out to the apparent target range is reached. At this point the required trajectory fall and drift is applied to the mirrors and the impact point projector switched on continuously to show the point of impact of the tracer round relative to the target.

The embodiments described can also display to the gunner the effect of firing tracer rounds (or missiles) which appear to diminish in size as they travel towards the target. This is achieved with the use of a servo motor controlled laser expander at the optical output of the impact point projector. The focus of the laser expander is adjusted by the servo motor, so as to form a spot 28 of the required size on the screen. The servo motor, therefore the spot size, is controlled using the flight time information. When the gun is fired (in simulation) the servo motor puts the impact point projector spot out of focus thus producing a large spot on the screen. As the flight time progresses the impact point projector spot is gradually brought into focus so as to produce a small spot. The effect of this diminisher is to give the gunner the illusion of seeing an apparently three dimensional change as the tracer round (or missile) is travelling towards the target.

In a modified apparatus the projector can continue to operate after the firing of the weapon/projectile instead of being stopped and the visible impact point projector operated momentarily to give a visual indication of the result of the shot.

I, therefore particularly point out and distinctly claim as my invention:

1. Projected image target apparatus for a simulated projectile or missile, comprising a screen, a projector for projecting a picture target onto the screen, means for projecting from a weapon a first light beam onto the screen along the line-of-sight of the weapon, means for projecting a second light beam onto the screen, and control means for controlling operation of the projector and the means for projecting said first and second light beams, said control means including means for tracking movement of the point of contact of said first light beam on said screen, means which upon firing of the weapon utilizes the position that the point of contact of said first light beam had at the instant of firing the weapon as a datum point relative to which the point of contact of the second light beam with the screen is moved to a corrected position which simulates for fall and drift of a simulated projectile or missile fired by the weapon and represents the point of impact of the projectile or missile relative to the point of aim of the weapon at the instant of firing.

2. Projected image target apparatus as claimed in claim 1, wherein said means which utilizes the position of the first light beam as a datum for moving the second light beam automatically discontinues the tracking means upon firing of the weapon.

3. Projected image target apparatus as claimed in claim 1, wherein the screen is translucent and the projector is arranged to project the image onto the back side of the screen.

4. Projected image target apparatus as claimed in claim 1, including means for simulating the sound of the firing of the weapon.

5. Projected image target apparatus as claimed in claim 1, wherein the first light beam is a beam of invisible radiation.

6. Projected image target apparatus as claimed in claim 1, wherein the means for projecting the second light beam is made operative after the weapon has been fired and the corrected position determined.

7. Projected image target apparatus as claimed in claim 1, wherein the means for projecting the second light beam is made operative at the instant of firing of the weapon.

8. Projected image target apparatus as claimed in claim 1, wherein the means for projecting the second light beam is mounted on a pivotable carrier so that the impact point of the second light beam on the screen can be moved vertically and horizontally.

9. Projected image target apparatus as claimed in claim 1, wherein a movable mirror system is provided to move the impact point of the second light beam on the screen vertically and horizontally.

10. Projected image target apparatus as claimed in claim 1, wherein the control means comprises means for storing or calculating for each of a plurality of different types of weapon or projectiles the flight times, trajectory fall and trajectory drift of a projectile or missile for a plurality of different range settings of the weapon, said means in use of the apparatus producing electical outputs dependent upon flight time and trajectory fall and drift, means for selecting the stored or calculated information relating to a particular weapon or projectile, means for obtaining the range in accordance with the assimulated range of the target image projected on the screen, means for detecting the firing of a weapon for producing a start signal, detection means for detecting the position of the point of contact of the first light beam on the screen, means for adjusting the detecting means so that the detection means maintain the point of contact of the first light beam in the centre of the field of view of the detection means, and means responsive to the produced electrical output of the storing or calculating means dependent upon the trajectory fall and drift of the projectile or missile for moving the point of contact of the second light beam on the screen vertically and horizontally on the screen.

11. Projected image target apparatus as claimed in claim 10, wherein the storing or calculating means comprises a first information store or computer for providing an electrical output signal dependent upon trajectory of a projectile for a selected range and a second information store or computer for providing an electrical output signal dependent upon the flight time of the projectile for said selected range.

12. Projected image target apparatus as claimed in claim 10, wherein the control means includes means for automatically resetting the control apparatus to re-centre the point of contact of the first light beam in the field of view of the detector means after a predetermined period of time has elapsed after effecting the adjusted position of the point of contact of the second light beam to allow for assessment of the result of the firing of the weapon.

13. Projected image target apparatus as claimed in claim 10, wherein the control means is provided with means responsive to the produced electrical output of the storing or calculating means dependent upon flight time of the projectile or missile for stopping the movement of the image on the screen for assessment of the shot.

14. Projected image target apparatus as claimed in claim 10, wherein the control means is provided with means responsive to the produced electrical output of the storing or calculating means dependent upon flight time of the projectile or missile for stopping the movement of the image on the screen for assessment of the shot, and the resetting means restarts movement of the film through the projector after said predetermined period of time.

15. Projected image target apparatus as claimed in claim 1, wherein the corrected position of the second light beam is gradually applied, while the second light beam is illuminated, simulating the effect of seeing the trajectory fall and drift of a tracer illuminated projectile.

16. Projected image target apparatus as claimed in claim 1, wherein the second light beam is controlled in size during the flight time of the simulated projectile or missile so as to produce the illusion that the projectile or missile is travelling away from the viewer.

* * * * *